US009831027B2

(12) United States Patent
De Leon

(10) Patent No.: US 9,831,027 B2
(45) Date of Patent: Nov. 28, 2017

(54) ELECTROSTATIC SHIELDING OF TRANSFORMERS

(71) Applicant: NEW YORK UNIVERSITY, New York, NY (US)

(72) Inventor: Francisco De Leon, New York, NY (US)

(73) Assignee: NEW YORK UNIVERSITY, New York, NY (US)

( * ) Notice: Subject to any disclaimer, the term of this patent is extended or adjusted under 35 U.S.C. 154(b) by 173 days.

(21) Appl. No.: 14/338,048

(22) Filed: Jul. 22, 2014

(65) Prior Publication Data

US 2015/0028989 A1 Jan. 29, 2015

Related U.S. Application Data

(60) Provisional application No. 61/857,581, filed on Jul. 23, 2013.

(51) Int. Cl.

| | |
|---|---|
| ***H01F 27/28*** | (2006.01) |
| ***H01F 27/24*** | (2006.01) |
| ***H01F 27/30*** | (2006.01) |
| ***H01F 27/36*** | (2006.01) |
| ***H01F 30/16*** | (2006.01) |

(52) U.S. Cl.

CPC ..... *H01F 27/306* (2013.01); *H01F 27/362* (2013.01); *H01F 30/16* (2013.01); *Y10T 29/49073* (2015.01)

(58) Field of Classification Search

CPC ..... H01F 27/25; H01F 27/245; H01F 30/16
USPC ..... 336/213, 216, 229
See application file for complete search history.

(56) References Cited

U.S. PATENT DOCUMENTS

| | | | | |
|---|---|---|---|---|
| 2,406,045 | A * | 8/1946 | Stevens | H01F 27/38 174/153 R |
| 2,478,030 | A * | 8/1949 | Vienneau | H01F 41/024 29/605 |
| 2,830,277 | A * | 4/1958 | Kane | B23K 5/006 29/609 |
| 3,374,452 | A | 3/1968 | Judd et al. | |
| 3,406,364 | A | 10/1968 | Russell et al. | |
| 4,131,867 | A * | 12/1978 | Quiogue | H01F 27/06 248/201 |
| 4,459,576 | A | 7/1984 | Fox | |
| 4,524,342 | A | 6/1985 | Mas | |
| 4,551,700 | A | 11/1985 | Waldeman | |
| 4,922,156 | A * | 5/1990 | Turcotte | H01G 4/40 315/239 |
| 5,488,344 | A | 1/1996 | Bisbee | |
| 5,838,220 | A | 11/1998 | Hagberg | |
| 6,300,857 | B1 | 10/2001 | Herwig | |

(Continued)

FOREIGN PATENT DOCUMENTS

| | | |
|---|---|---|
| CN | 203521141 | 4/2014 |
| EP | 190930 A2 | 8/1986 |
| JP | 62154710 A * | 7/1987 |

*Primary Examiner* — Tsz Chan
(74) *Attorney, Agent, or Firm* — Foley & Lardner LLP

(57) ABSTRACT

Toroidal transformers are currently used only in low-voltage applications. There is no published experience for toroidal transformer design at distribution-level voltages. Toroidal transformers are provided with electrostatic shielding to make possible high voltage applications and withstand the impulse test.

11 Claims, 10 Drawing Sheets

Shorting of first turn of H.V. winding with the core

(56) References Cited

U.S. PATENT DOCUMENTS 6,753,749 B1 6/2004 Chin
7,834,736 B1 * 11/2010 Johnson ..... H01F 27/022
336/182

* cited by examiner

100

Figure 7A
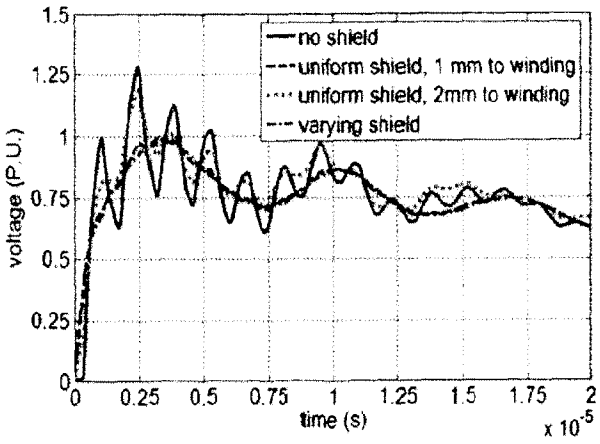
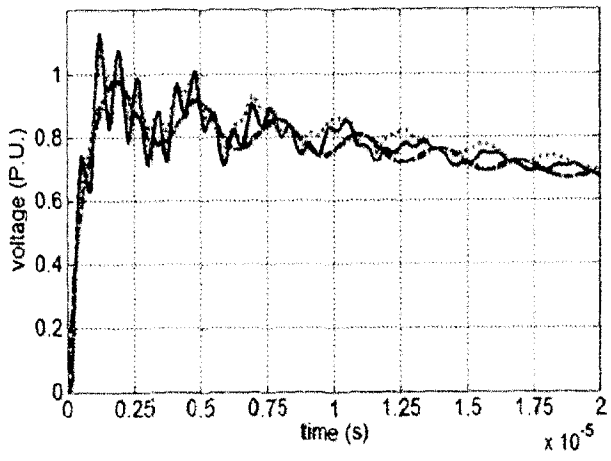
Figure 7B
Figure 6A
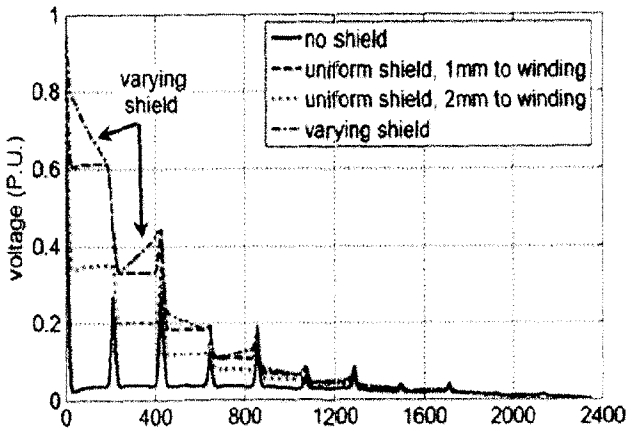
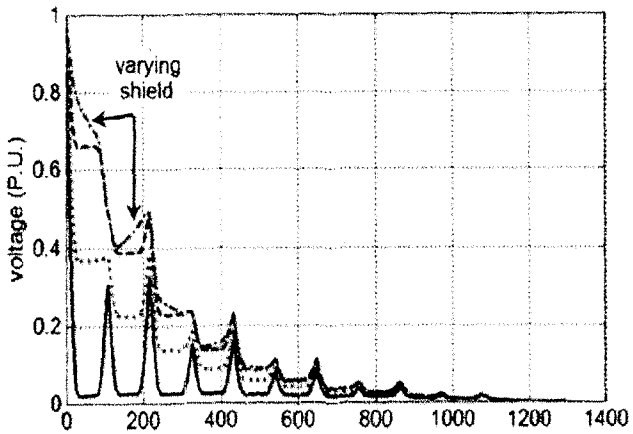
Figure 6B Figure 9A
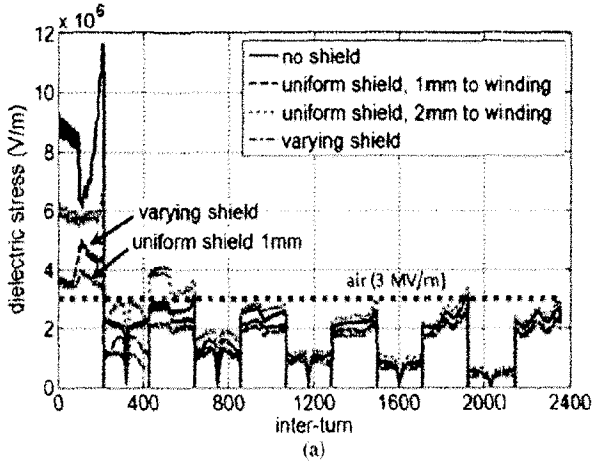
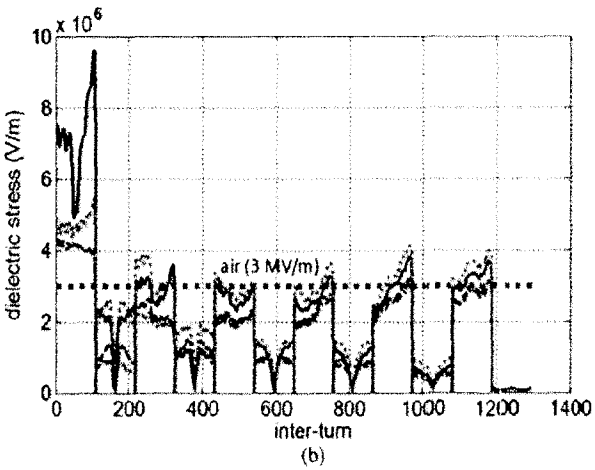
Figure 9B
Figure 8A
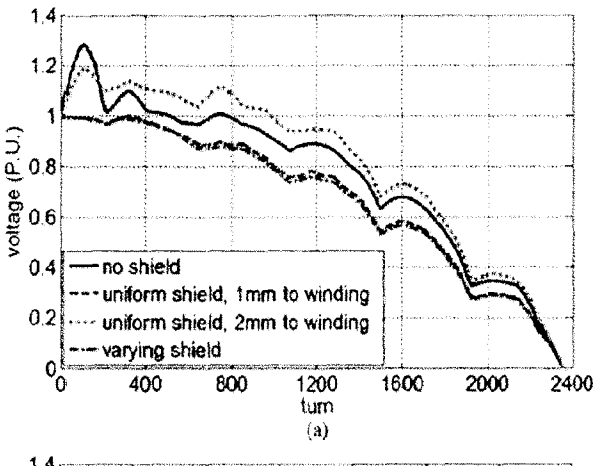
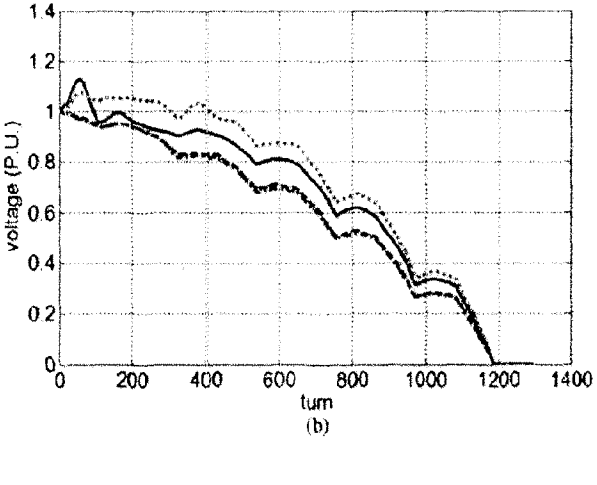
Figure 8B Shorting of first turn of H.V. winding with the core

ELECTROSTATIC SHIELDING OF TRANSFORMERS

CROSS REFERENCE TO RELATED APPLICATIONS

This application claims priority to U.S. Provisional application No. 61/857,581 filed Jul. 23, 2013, reference of which is herein incorporated in its entirety.

STATEMENT OF GOVERNMENT INTEREST

The United States Government has rights in the invention described herein pursuant to Grant No. DEOE0000072 through the Department of Energy.

FIELD OF THE INVENTION

The present invention generally relates power transmission and distribution, more specifically to transformers.

BACKGROUND OF THE INVENTION

The U.S. Environmental Protection Agency estimates losses of 60 to 80 billion kWh attributable to distribution transformer inefficiencies, which rob U.S. business and American consumers of approximately $4 billion per year. Currently, there are two basic arrangements for the iron-cores used to build distribution transformers: (1) "Core-Type" having cores assembled by stacking laminations and the transformer is completed by sliding pre-made windings; (2) Shell-Type having a continuously wound core that is cut and wrapped around the windings a few laminations at a time. In both arrangements, the finished core has air gaps that increase the magnetizing current and the no-load losses.

Toroidal transformers are not presently in use in power distribution systems. Toroidal transformers have typically exhibited unacceptable failure when subjected to the "impulse test". To assure the quality of the insulation system, all utility-grade pieces of equipment should pass the lightning impulse test, among other tests. This test is performed in high voltage laboratories and consists of applying a set of lightning strikes of a given intensity and shape to the equipment under test. In the case of a distribution transformer, even one rated at 2.4 kV, the applied lightning impulses are of 95 kV. This test serves to give confidence to utilities that the transformer will not fail at energization or on the first electrical storm. Given the lack of experience with toroidal design at medium and high voltages, efforts have been made to develop the technology to pass the impulse tests as well as study the thermal performance and produce a sound mechanical design. Some of the design issues that have been solved include: Impulse response, matching the specification of leakage impedance, and thermal analysis. Reported problems with previous medium-high voltage toroidal transformer designs include failure to pass the impulse test, a low utilization factor, and the destruction of the core during the short-circuit test due to the strong electromagnetic forces.

SUMMARY OF THE INVENTION

One embodiment of the invention relates to toroidal transformers having an electrostatic shield. The toroidal transformers comprise a core and windings. The core is electrically floating but also includes a connection to the high voltage winding. Thus, the core also functions as the electrostatic shield by connecting it to the high-voltage terminal.

Another embodiment relates to a method of electrostatically shielding a toroidal transformer having a core with concentrically wound a high voltage winding and low voltage winding. The method comprises electrically connecting the high voltage winding and the core.

Another embodiment relates to a transformer. The transformer includes a core having a laminated metal core wound into a coil forming a plurality of layers and forming an aperture and generally defining a toroidal shape. The laminated metal core comprises an insulating portion and a metallic portion, such that each of the plurality of layers include an insulation portion and a metallic portion. A first winding is disposed about the core and comprising a plurality of first winding turns each of which pass through the aperture. A second winding is disposed about the core and comprising a plurality of second winding turns each of which pass through the aperture. An electrical connection exits between the first winding and the core.

Additional features, advantages, and embodiments of the present disclosure may be set forth from consideration of the following detailed description, drawings, and claims. Moreover, it is to be understood that both the foregoing summary of the present disclosure and the following detailed description are exemplary and intended to provide further explanation without further limiting the scope of the present disclosure claimed.

BRIEF DESCRIPTION OF THE DRAWINGS

The foregoing and other objects, aspects, features, and advantages of the disclosure will become more apparent and better understood by referring to the following description taken in conjunction with the accompanying drawings, in which:

FIGS. 6A and 6B illustrate an initial potential distribution. (a) 25-kVA transformer. (b) 50-kVA transformer FIGS. 7A and 7B illustrate a transient response at the turn of maximum voltage stress: (a) 25-kVA transformer, turn 107. (b) 50-kVA transformer, turn 52.

FIGS. 8A and 8B illustrate an impulse potential distribution: (a) 25-kVA transformer. (b) 50-kVA Transformer.

FIGS. 9A and 9B illustrate an interturn dielectric stress. (a) 25-kVA transformer. (b) 50-kVA transformer.

FIG. 13 illustrates a toroidal transformer with a core and high voltage winding with an electrical connection there between.

DETAILED DESCRIPTION OF THE PREFERRED EMBODIMENTS

Figure 1:
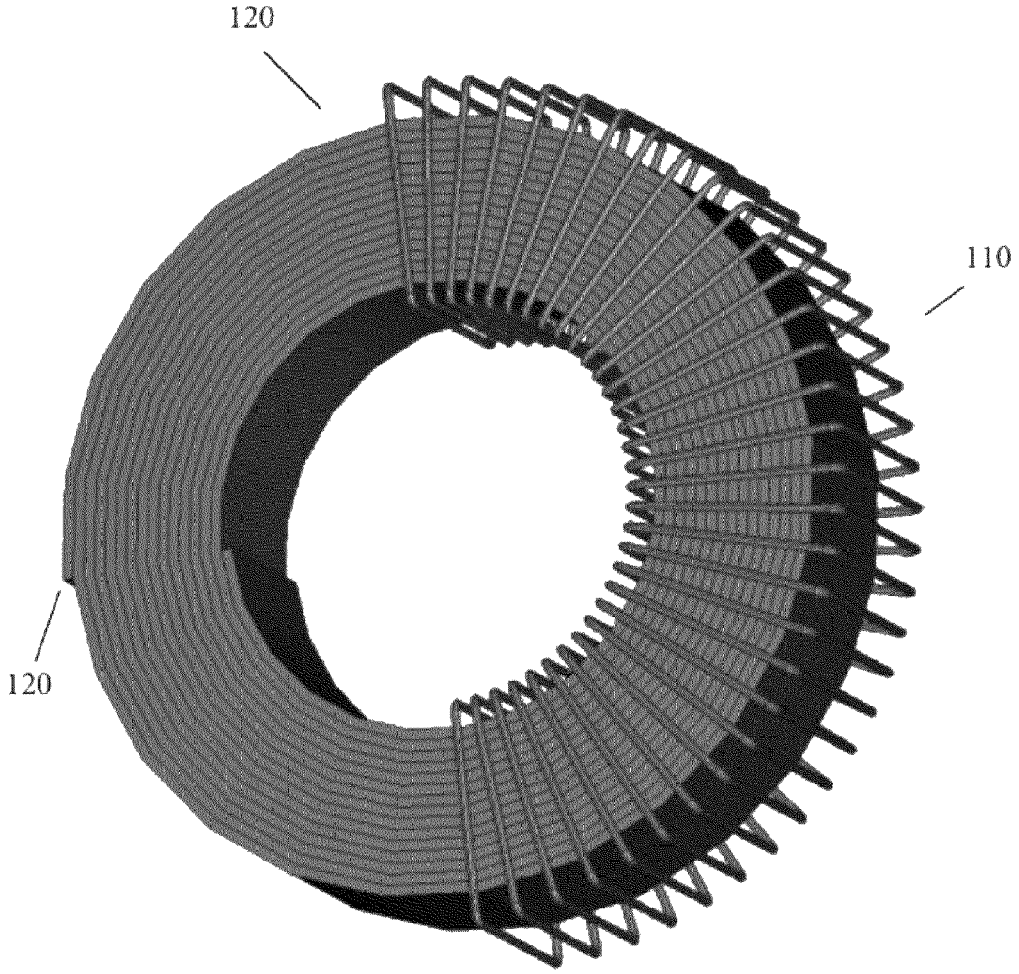
FIG. 1. Toroidal transformer (only a few turns of one winding are shown).

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the figures, can be arranged, substituted, combined, and designed in a wide variety of different configurations, all of which are explicitly contemplated and made part of this disclosure.

Toroidal transformers have many advantages over traditional constructions. However, they are not used today in power distribution because no one has been able to build one that meets all specifications necessary for transformers utilized in electricity transmission and distribution systems. Passing the impulse tests by adding too much insulation would yield to thermal problems and failure of the efficiency constraint. Then a much larger transformer would have to be built or oil would be needed to cool the transformer. FIG. 1 illustrates an example of a toroidal transformer, though only a portion of one winding is shown. The transformer 100 includes a core 120 and windings 110, the core 120 includes a plurality of laminated layers 121. The toroidal core may comprise a ferrous material and be provided as a series of laminated layers wound into a coil to form a "ring" defining the toroidal shape. A first winding 110 is coiled around the core, with each turn passing through the aperture of the core 120. A second winding [not shown] also wraps around the core 120 with each turn passing through the aperture of the core 120. The first winding 110 and the second winding may be concentrically wound about the core 120.

As further described below, embodiments relate to toroidal transformers having electrostatic shielding and methods of electrostatically shielding toroidal transformers. In one embodiment, toroidal transformers use a core made of a continuous steel strip that is wound into a doughnut shape (toroid) and then wrapped entirely in coils. This gapless construction allows for smaller, more efficient, lighter, and cooler transformers with reduced electromagnetic interference and lower acoustic noise. The main technical advantage is that the no-load loss is substantially reduced. There are also savings to be found in the load losses because the windings have fewer (and shorter) turns; these transformers can be designed with a higher flux density.

Since toroidal transformers can be made smaller than standard transformers, it is believed that oil immersed overhead transformers can be replaced with dry toroidal units; reducing the potential for violent faults in addition to the environmental benefits of avoiding the use of oil. Toroidal core transformers are superior because of the gapless construction that allows for designs to have a reduced no-load loss. Transformers with small no-load loss are well-suited for lightly loaded (suburban and rural) areas to replace pole mounted transformers.

The no-load losses are substantially reduced. There are also savings in the load losses because the windings have fewer turns since these transformers can be designed with a larger flux density. Therefore, there are savings in raw materials (iron and copper) for the same losses than a standard design and even the tank is smaller.

As described further herein, the lightning impulse response of a toroidal distribution transformer was analyzed in order to obtain a dielectric design able to withstand standardized impulse tests. This is done by means of three-dimensional (3-D) finite-element simulations, as well as electromagnetic transient simulations considering a lumped parameter RLC (turn-by-turn) model of the transformer winding. These computational tools, which have been extensively used for electromagnetic transient analysis of conventional transformer arrangements but are now applied for a novel toroidal distribution transformer.

Specifically, two particular implementations of insulation design strategies are described and their effectiveness in reducing the transient voltage and dielectric stress in the winding is demonstrated. The first one is the addition of an electrostatic shield uniformly spaced with respect to the winding. The second one is the use of an electrostatic shield that has a varying distance to the winding, by means of a gradual increase of insulation thickness between the winding and shield (without affecting the winding positions). The two strategies are equally successful to properly distribute the impulse surge. The selection between them depends on manufacturer efficiencies and preferences.

The dynamic performance of the toroidal transformer insulation system for lightning impulse was studied by means of two examples: one transformer of 25 kVA and another one of 50 kVA. Both transformers have the same ratings in terms of voltage ratio (13.8/0.120 kV) and BIL (95 kV). However, the use of insulation design strategies such as the addition of an electrostatic shield uniformly spaced with respect to the winding or the use of an electrostatic shield that has a varying distance to the winding, by means of a gradual increase of insulation thickness between the winding and shield (without affecting the winding positions) result in electrostatic shielding but also poor thermal properties and failure with regard to thermal requirements. Specifically, an electrostatic analysis was done using an electrostatic shield, inverted C-shaped, for the toroidal transformer constructed by means of a thin conductor material covered by an insulation layer and partially wrapped around the winding. The internal part of the winding remains unshielded (unwrapped) since the turns are close enough to each other in this region; see FIG. 5. In addition, it is believed that the size (and, therefore, the cost) of the toroidal transformer is very much dependent on the minimum internal diameter needed for the winding machine. Therefore, not shielding the center is convenient. As noted, this structure resulted in failure with regard to thermal properties.

Electrostatic Analysis

Figure 2:
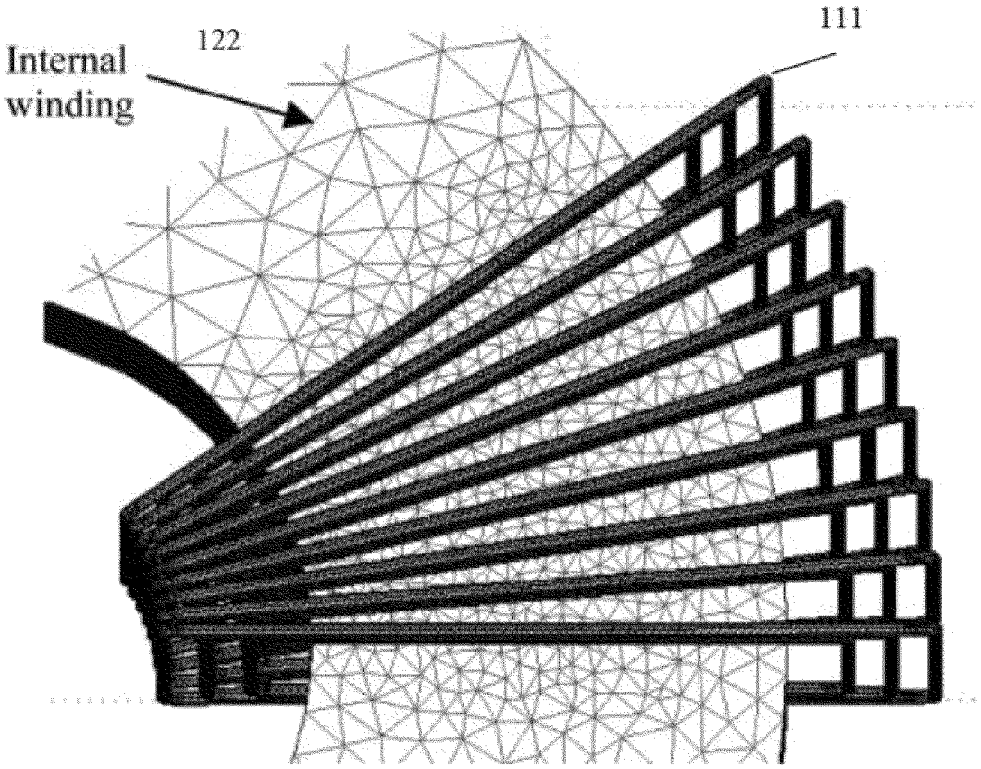
FIG. 2. Geometry and meshing for Finite Element Method simulations (distances between layers were exaggerated for illustration purposes).

Given the complex geometry of the windings in a toroidal transformer, a 3-D arrangement is required for the electrostatic analysis, as shown in FIG. 2. FIG. 2 illustrates one set of geometry and meshing 122 used in performing an FEM simulation. The internal (low-voltage winding, which is grounded) is represented by a solid toroidal shape since its detailed representation is not needed. Note that the transformer core is not visible. For the purposes of this paper, each turn of the high-voltage winding is modeled as a closed loop, then the mutual capacitances can be obtained from the energy method.

Assuming that the high-voltage winding has N layers and n turns per layer, the following capacitive values need to be computed:

$C_{s,o}$ self-capacitance of any turn at the outer layer (N);

$C_{s,i}$ self-capacitance of any turn at the inner layer (1);

$C_{s,m}$ self-capacitance of any turn at any interior layer (2, . . . N−1);

$C_{it,o}$ mutual capacitance between any two adjacent turns at the outer layer (N);

$C_{it,i}$ mutual capacitance between any two adjacent turns at the inner layer (1);

$C_{it,m}$ mutual capacitance between any two adjacent turns at any interior layer (2, . . . N−1);

$C_{iL,o}$ mutual capacitance between the ith turn at the outer layer and the ith turn at the following interior layer;

$C_{iL,m}$ mutual capacitance between the ith turns of any two interior layers.

These elements are computed by means of FEM simulations using the electrostatic energy method. Self-capacitances are computed from the electrostatic energy $W_i$ obtained when applying a voltage $V_i$ to the ith turn of the winding $$W_i = \frac{1}{2}C_{ii}V_i^2. \tag{1}$$

Mutual capacitance $C_{ij}$ is computed from the electrostatic energy $W_{ij}$ obtained when applying voltage at both turns i and j $$W_{ij} = \frac{1}{2}C_{ij}V_iV_j - \frac{1}{2}(C_{ii}V_i + C_{jj}V_j). \tag{2}$$

Self-capacitances must be calculated first from (1) in order to obtain the mutual elements from (2). Mutual capacitances between nonadjacent turns or layers are not considered since FEM simulations have shown that, for the arrangements under study, their values are at least one order of magnitude smaller than the values between adjacent turns. Transient simulations in which capacitive values for all turns (including nonadjacent) were included confirmed that they have no effect on the results for the geometrical configuration under analysis.

An important issue when finding the solution of such a detailed geometry lies in the finite-element meshing. Considering the thin insulation between turns produces very narrow regions. This is particularly true at the internal part of the winding. Therefore, a very large number of elements (in the order of millions) are required to obtain an accurate solution.

Taking advantage of the toroidal symmetry to speed up the simulations and consume less memory, the geometry can be simplified by considering only a section of the actual number of turns and layers. For the example shown in FIG. 2, three layers and nine turns per layer are found sufficient to approximate the capacitance values of a real arrangement of 11 layers with 214 turns per layer. This has been validated by initial simulations in which the results from the complete geometry are compared to those of the simplified one.

Each electrostatic simulation for the calculation of the capacitive matrix takes about 12 min in a powerful computer [two Xeon multicore processors running at 2.27 GHz with 72-GB random-access memory (RAM)].

It can be observed in FIG. 2 that in contrast to shell- or core-type transformers, the distance between turns in a toroidal configuration is not constant. While the distance between turns at the internal part of the toroid is kept at the minimum required to avoid dielectric breakdown, the distance at the external part is several times larger, resulting in small capacitive coupling between turns (series capacitance). Thus, the well-known distribution constant $\alpha = \sqrt{C_{ground}/C_{series}}$ is several times larger for toroidal transformers than that for conventional constructions. This particularity of toroidal transformers produces highly nonuniform initial potential distribution (at the wavefront), giving rise to large dielectric stresses as well as increased transient overvoltages. This makes the use of electrostatic shielding necessary.

Transient Analysis

Fast and very fast front transients in transformers are commonly analyzed using internal models, which can take into account the distribution of the incident surge along the windings. These models are described either by distributed parameters, using the transmission-line theory or as a ladder connection of lumped parameter segments. The latter models can be solved by network analysis or by integrating the corresponding state-space equations.

In addition, an admittance matrix model (black-box model) based on terminal measurements has been presented previously in the prior art. This model can be implemented in time-domain simulation programs by means of a rational approximation procedure. For the size of a distribution toroidal transformer and the frequency range involved in the lightning waveform, a turn of the transformer can be considered electrically short. Therefore, a lumped parameter model considering a winding turn as the basic element is chosen in this paper.

A lumped parameter model was used to obtain the transient response of the winding. It is based on known models and considers a lossy and frequency-dependent multilayer winding.

After computing the winding capacitance matrix C, the geometric inductance matrix is obtained as $$L = \mu_0 \epsilon C^{-1}. \tag{3}$$

In (3), $\epsilon$ is the permittivity of the surrounding medium. Conductor losses due to skin and proximity effects can be computed from the following expression:

$$R = \frac{1}{d}\sqrt{\frac{2\omega}{\sigma_c \mu_c}}\, L. \tag{4}$$

Figure 3:
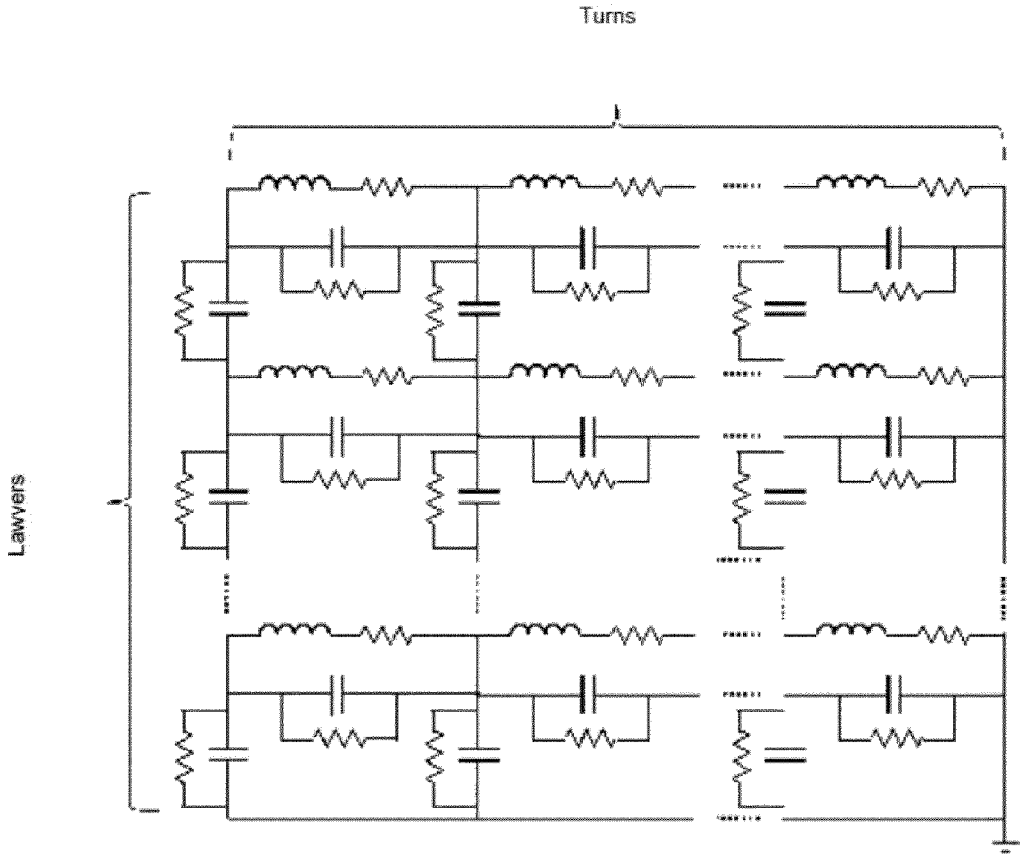
FIG. 3. Circuital representation of the winding. Mutual inductances between turns and between layers, as well as ground capacitances of outer layers, are omitted in the figure for the sake of simplicity.

In (4), d is the distance between layers, $\omega$ is the angular frequency, $\sigma_c$ is the conductivity of the winding conductor, and $\mu_c$ is its permeability. On the other hand, dielectric losses can be included in the form of a shunt conductance matrix given by $$G = (\omega \tan \delta)C \tag{5}$$

Where $\delta$ is the loss tangent of the winding insulation. From matrices R, L and C, and G, a nodal system can be defined to describe the winding (FIG. 3)

$$I(\omega) = Y(\omega)V(\omega) \tag{6}$$

where V(ω) and I(ω) correspond to the vectors of nodal voltages and currents, and Y(ω) is the nodal admittance matrix, which is defined as follows:

$$Y(\omega)=G+j\omega C+\Gamma+G_{con}. \tag{7}$$

Matrix $G_{con}$ contains the conductance elements required for the topological connection of layers, as well as the source and ground connections (if needed); is the nodal matrix of inverse impedance, computed from Z=R+jωL and the incidence matrix K (since Z is a branch matrix)

$$\Gamma=KZ^{-1}K^{t} \tag{8}$$

where $$K=\begin{bmatrix} 1 & 0 & 0 & \dots & 0 & 0 \\ -1 & 1 & 0 & \dots & 0 & 0 \\ 0 & -1 & 1 & \dots & 0 & 0 \\ \vdots & \vdots & \vdots & \ddots & \vdots & \vdots \\ 0 & 0 & 0 & \dots & 1 & 0 \\ 0 & 0 & 0 & \dots & -1 & 1 \end{bmatrix}. \tag{9}$$

Finally, the time-domain response of the winding is obtained by solving (6) for V and applying the inverse numerical Laplace transform.

$$\max(DS_{ij})=\frac{|V_i-V_j|}{\min(d_{ij})}.$$

Maximum dielectric stresses (DS) between turns and between layers can be obtained from the elements of the nodal voltages Vector V and the minimum distance between corresponding turns as $$\max(DS_{ij})=\frac{|V_i-V_j|}{\min(d_{ij})}. \tag{10}$$

Electrostatic Shielding

There are three essential methods to improve the impulse response of power transformers: 1) electrostatic shielding; 2) addition of dummy strands; and 3) interleaving of turns. The latter method is, in general, preferred for transformers working at high-voltage transmission levels. However, for a toroidal transformer working at the distribution-level voltage with a large turns ratio (e.g., 13.8/0.120 kV), the winding arrangement (by layers) and the small cross-sectional area of the winding conductors makes it cumbersome and ineffective to attempt any interleaving or addition of dummy strands.

Figure 4:
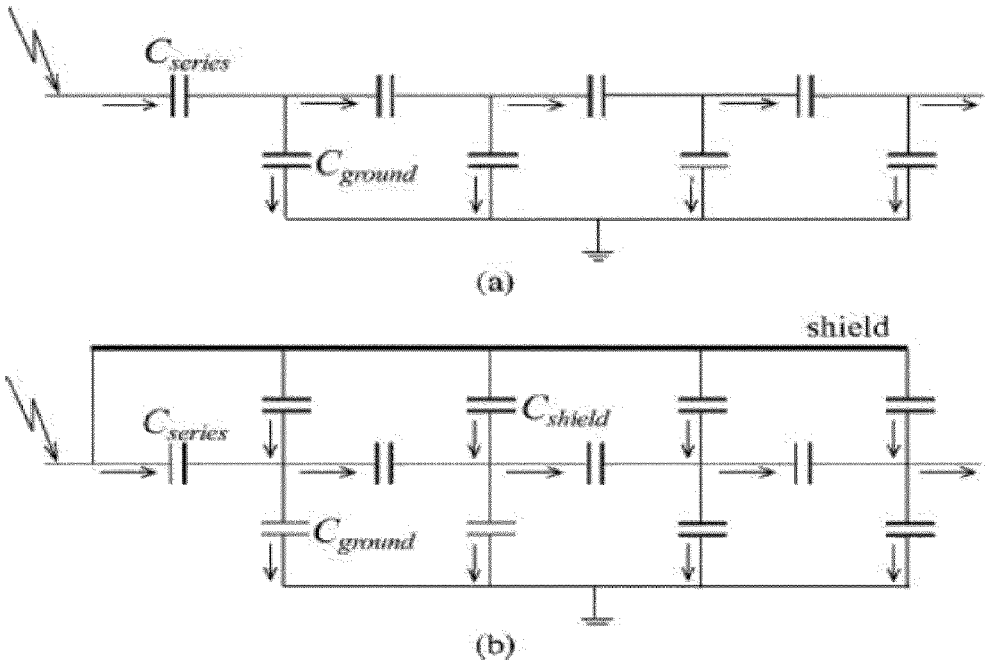
FIGS. 4A and 4B illustrate an initial current distribution along the winding. (a) Original. (b) With the electrostatic shield.
Figure 13:
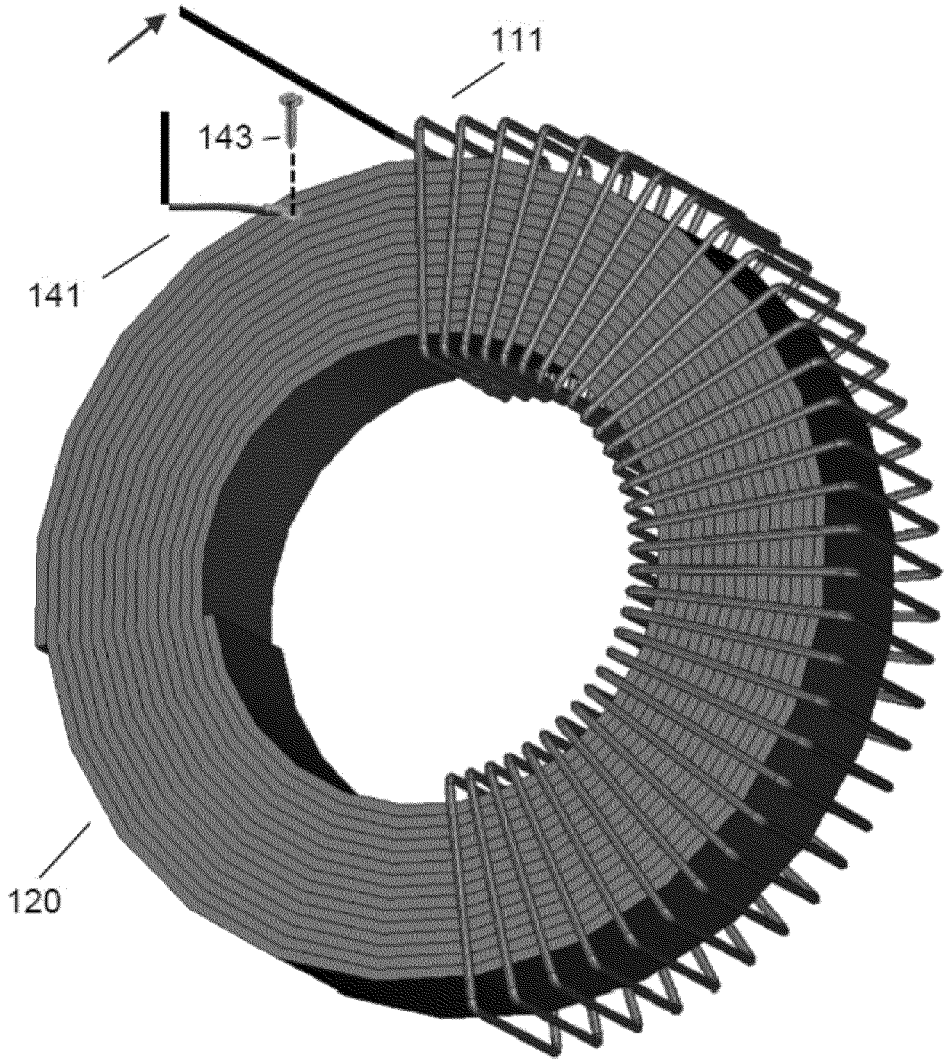

FIG. 4 illustrates an initial current distribution along the winding. (a) Original. (b) With the electrostatic shield. The electrostatic shield, such as shown in FIG. 13, enables the toroidal transformer to pass the impulse test without encountering fatal thermal problems observed in other implementations of shielding. The use of electrostatic shields to improve the lightning impulse performance of high-voltage equipment has been effective for many decades. The unique feature of the electrostatic shield used in the toroidal transformer is that the magnetic core, which is electrically floating, also functions as the electrostatic shield by connecting it to the high-voltage terminal. This is different from current technology that has the magnetic core connected to the transformer tank and is always grounded.

The function of the electrostatic shield is to produce a more uniform distribution of the electrical stresses that the inter-turn and inter-layer insulation undergo during the impulse test. Without the electrostatic shield, the insulation system could fail and produce short-circuits during the test.

In certain implementations, electrostatic shielding is chosen for toroidal distribution transformers. Its basic idea is to improve the initial potential distribution by compensating the current drained by the ground capacitances with currents injected to the series capacitances.

In certain implementations, the distance between the shield and the winding is of particular importance. The shield has to be close enough to the winding to be effective and far enough from the winding to avoid dielectric breakdown. This is analyzed for the test case presented in the following examples.

TABLE 1

Main Geometrical Data of the Transformers Under Study

| Rating [kVA] | 25 | 50 |
|---|---|---|
| External diameter of the core [mm] | 510 | 600 |
| Internal diameter of the core [mm] | 250 | 250 |
| Conductor Gauge [AWG] | 11 | 7 |
| Conductor diameter [mm] | 2.3048 | 3.6648 |
| Distance between layers [mm] | 1.0762 | 1.0940 |
| Distance between winding and core [mm] | 1.0000 | 1.0000 |
| Minimum distance between turns [mm] | 0.0762 | 0.0940 |
| Number of layers | 11 | 12 |
| Number of turns per layer | 214 | 108 |

From the results of the simulations performed, the following conclusions are obtained:

1. interturn stress is low for the whole winding; atypical insulation film corresponding to its AWG size and a dielectric strength above 12 MV/m is shown to be adequate for the tested cases;
2. interlayer stress is the critical factor for these types of transformers; the distance between layers has to be carefully selected to avoid interlayer breakdown;
3. the inclusion of a shield at 1 mm from the winding or a shield with a varying distance to the winding (from 0.1 to 1 mm) results in lower interturn and interlayer stress as well as damped transient voltages;
4. when a uniform shield is considered, the distance between the shield and winding has to be carefully selected in order to achieve the largest possible reduction in dielectric stress and transient voltage while avoiding dielectric breakdown between the shield and winding;
5. certain implementations should include a shield with a varying distance to the winding, which prevents dielectric breakdown between the winding and shield.

Figure 12:
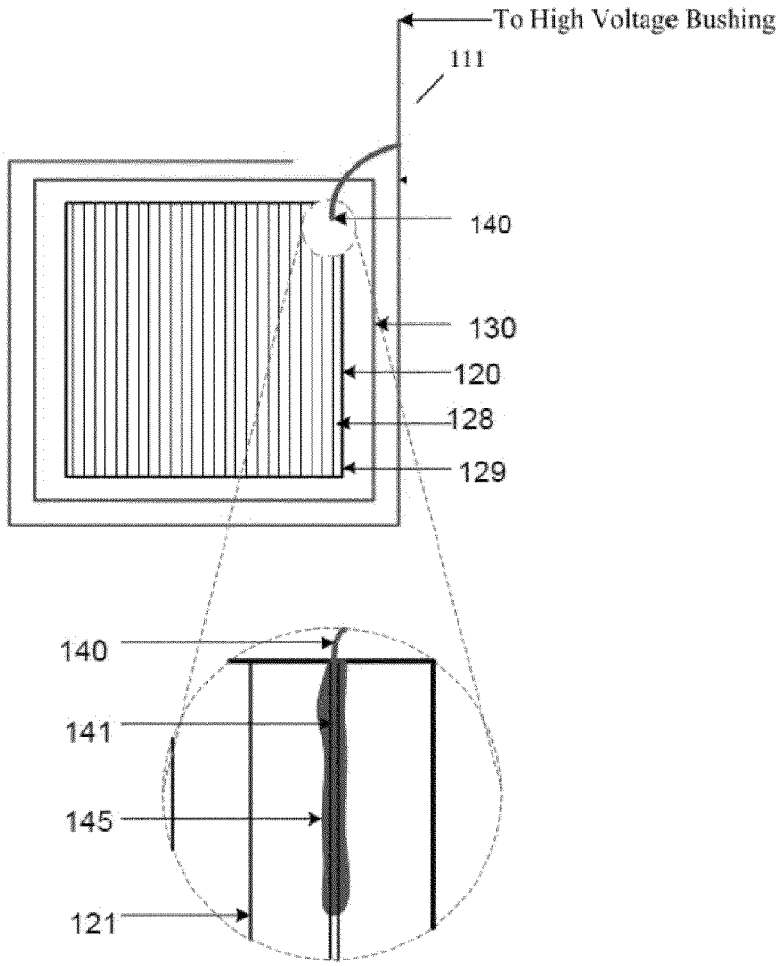
FIG. 12 illustrates partial view of a core and high voltage winding for a toroidal transformer having an electrical connection, with the inset image showing a close-up view of the position of the electrical connection on the core.

FIG. 12 describes one of the possible procedures and structures used to connect the laminations layers 121 of the core 120 to the first turn 11 of the high-voltage winding 110. This implementation inverts the winding sequence of typical low-voltage toroidal designs. As illustrated in FIG. 12, the high voltage winding 110 is connected to the core 120. In one embodiment, as best shown in the inset, an electrical connection 141 is made between the high voltage winding and the last layer of the core. In on embodiment, the connection is created by removing insulation 145 between the outer (i.e. "last") layer 129 of the core and the next-to outer (i.e, "layer before last") 128 to expose the metal and place the electrical connection 140 in contact with the core 120 on one end and the high voltage winding 110 on the other. Insulation 130 may be provided between the winding 110 and the core 120. In one embodiment, the insulation 125 removed is from adjacent layers such that the metallic portions of two adjacent layers are exposed allowing for a conductive connection to both layers.

The electrical connection 140 between the core 120 and the high voltage winding 110 may be achieved by various known physical mechanisms for electrically connecting the winding 110 and core 120. For example, as shown in FIG. 12, a wire 141 may be used for the electrical connection 140 and secured to the core 120 using copper tape or the like. In one implementation, the wire 141 used for the electrical connection is the same material as used in the winding 110. Alternatively, as shown in FIG. 13, a wire 141 can be secured to the core 120 by inserting a screw 143 or other mechanical fastener (that can serve as a conductor) between the layers 128, 129 of the core.

Figure 5:
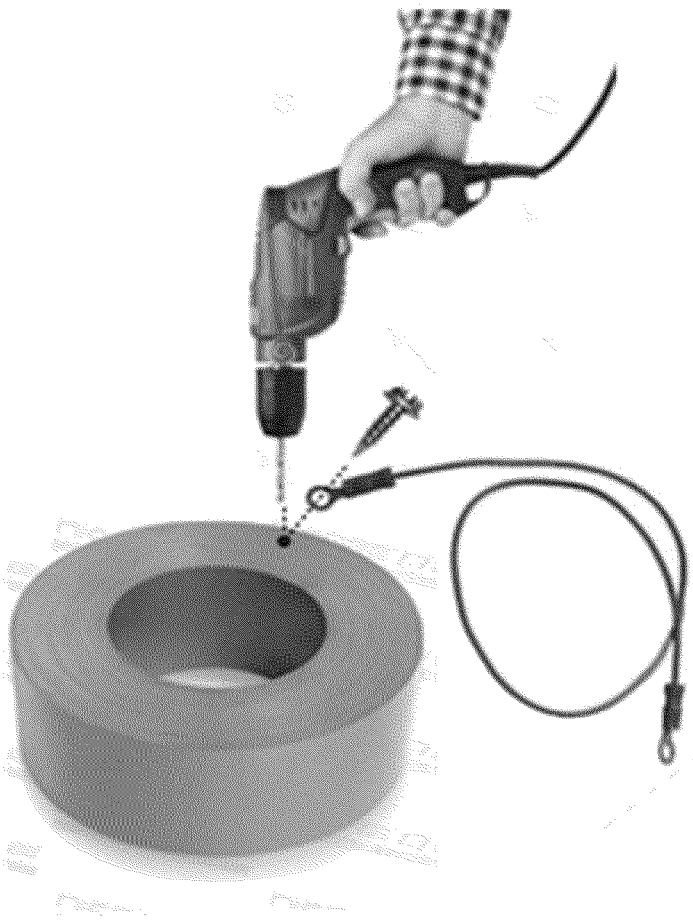
FIG. 5. A view of a toroidal transformer with a wire being installed for creation of an electrostatic shield.

FIG. 5 shows aa core 120 electrically connected to a high voltage (HV) terminal to use less insulation between the core 120 and the winding 110. Therefore, the inner winding 110 is the HV and the low voltage (LV) winding is wound on top of the HV winding 110. This technique creates an electrostatic shield between the core 120 and the HV winding 110. The function of the electrostatic shield is to produce a more uniform distribution of the electrical stresses that the inter-turn and inter-layer insulation undergo during the impulse test.

FIG. 13 illustrates a view of a toroidal transformer illustrating how the electrical connection can be placed with respect to the core and the high voltage winding.

EXAMPLES

Electrostatic Shielded Toroidal High Voltage Transformer

A dry-type 25 kVA distribution transformer, 13.2 kV primary to 240/120 V secondary, 95/30 kV BIL, was built and tested to have an efficiency of 98.63% (at full load). These are the characteristics of a typical pole mounted transformer currently in use by many utilities. However, its performance is not typical; the transformer has a no-load loss of only 36.4 W. A standard transformer has a no-load loss between 70 and 180 W. Thus even the finest transformer built today with standard technology has double the amount of no-load loss than the prototype toroidal transformer. The transformer fits in a 24" diameter tank (30" high) and it has passed the impulse tests at Kema high-voltage laboratory Two toroidal transformers with a rating of 25 and 50 kVA are considered. The voltage ratio and BIL rating are the same for both: 13.8/0.120 kV and 95 kV. The main geometrical data of the high-voltage windings of these two transformers are listed in Table I. The following assumptions are made for simulation purposes:

- The number of turns is considered equal for all layers; in an actual transformer, each outer layer has fewer turns than the previous one.
- Due to the previous assumption, turns from each layer are considered completely aligned, as shown in FIG. 2.
- The minimum distance between turns is given by the typical thickness of the varnish film for the corresponding conductor diameter.
- The distance between layers is initially assumed to be 1 mm (plus the conductor varnish).

TABLE II

Reduction of the Interlayer Stress with Application of the Electrostatic Shielding

| | Dielectric stress reduction (%) | | | |
|---|---|---|---|---|
| | Uniform Shield | | Varying Shield | |
| Inter-layer | 25 kVA | 50 kVA | 25 kVA | 50 kVA |
| 1-2 | 12.0 | −3.9* | 17.0 | −5.1* |
| 2-3, 3-4 | 22.3 | 9.2 | 23.9 | 11.2 |
| 4-5, 5-6 | 21.5 | 25.7 | 25.1 | 28.4 |
| 6-7, 7-8 | 16.3 | 16.3 | 19.3 | 18.3 |
| 8-9, 9-10 | 13.5 | 13.7 | 16.0 | 15.8 |
| 10-11, 11-12 | 14.6 | 14.1 | 17.0 | 15.9 |
| HV-LV | 14.5 | 10.2 | 17.4 | 16.6 |

*Negative values correspond to an increase in stress

TABLE III

Capacitive Values for the 25-kVA and 50-kVA Transformers without Shielding

| | Value (pF) | |
|---|---|---|
| Capacitance* | 25 kVA | 50 kVA |
| $C_{s\,o}$ | 71.71 | 104.32 |
| $C_{s,i}$ | 56.67 | 84.23 |
| $C_{s,m}$ | 63.20 | 88.70 |
| $C_{it,o}$ | 25.78 | 35.23 |
| $C_{it,i}$ | 10.45 | 10.90 |
| $C_{it,m}$ | 15.48 | 16.44 |
| $C_{iL,o}$ | 13.43 | 24.76 |
| $C_{iL,m}$ | 12.74 | 23.24 |

The set of capacitive values obtained from FEM for both transformers is listed in Table III. An alternating direction of the winding between layers is proposed (i.e., if the first layer is wound in the clockwise direction, then the 2nd layer is wound in the counterclockwise direction and so forth). This winding strategy yields reduced dielectric stresses when compared with continuous (same direction) windings.

The transient response of the transformers is analyzed by means of the injection of a standard 1.2/50-μs lightning impulse (full wave) at the initial terminal of the winding, which is located at the outermost layer of the winding.

FIG. 6 shows the initial potential distribution along the windings. As expected, the potential distribution without shield (continuous line) is highly nonuniform for both transformers. In addition, some spikes can be seen, which are a consequence of the capacitive coupling between layers at the layers' ends. This distribution can be improved by including an electrostatic shield in the transformer design.

The way in which the different shields affect the initial potential distribution is shown in FIG. 6. By producing a more uniform distribution, the voltage drop between consecutive turns along the winding is reduced.

FIG. 7 shows the transient response of the winding at turn 107 for the 25-kVA transformer and at turn 52 for the 50-kVA transformer, corresponding to the regions of maximum voltage stress. One can appreciate that the shield is able to damp the transient oscillations reducing the maximum transient voltages. In addition, as expected, the closer the shield is to the winding, the larger the mitigation of the overvoltage. However, this distance is limited by the dielectric strength of the insulation between winding and shield. The results for the uniform shield distanced 1 mm to the winding and the varying shield are almost identical for both transformers.

FIG. 8 illustrates the distribution of the maximum voltage obtained along the winding for the whole transient period, hereafter called the impulse potential distribution. The voltage distribution along the whole winding of the different shielded transformers is more uniform compared to the unshielded transformers. The performance of the varying shield in the context of mitigating the transient voltage is very similar to that of the uniform shield separated 1 mm from the winding. With these two shielding strategies, the maximum value of the transient voltage is reduced by 21.8% for the 25-kVA transformer, and by 11.3% for the 50-kVA transformer, with respect to the unshielded case.

The dielectric performance of the winding is analyzed considering three main variables:

1. interturn dielectric stress;
2. interlayer dielectric stress;
3. winding-to-shield dielectric stress.

FIG. 9 shows the interturn stress along the complete winding. It can be seen in the plots how the stress is reduced by applying the different shields. The maximum value of interturn stress in the 25-kVA and the 50-kVA transformers is reduced by 57.2% and 56.1%, respectively, with the uniform shield being located 1 mm from the winding. On the other hand, these stresses are reduced by 65.4% and 55.6% with the varying shield. It can also be noticed that even without any shield, the stress is kept to an acceptable level. The maximum value obtained for both transformers is well below the dielectric strength of any high-performance varnish. Therefore, no extra insulation needs to be added between turns.

Figure 10A:
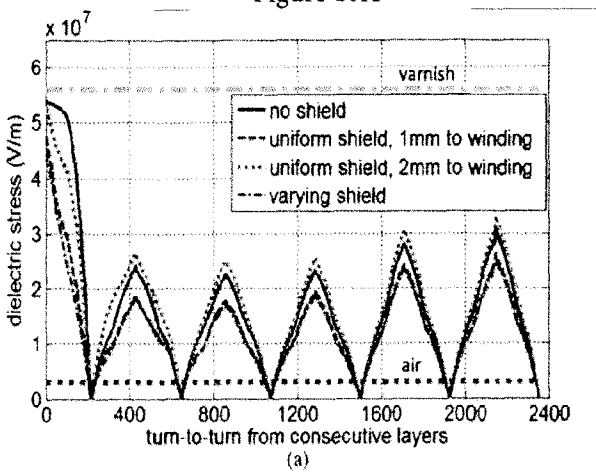
FIGS. 10A and 10B illustrate an interlayer dielectric stress. (a) 25-kVA transformer. (b) 50-kVA transformer.
Figure 10B:
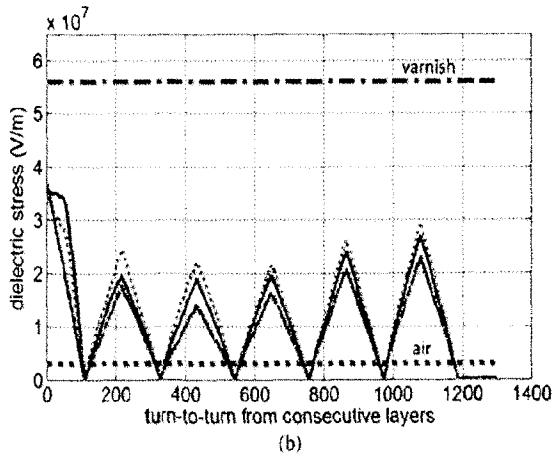

The interlayer stress is plotted in FIG. 10. The interlayer stresses are several times larger than the interturn stresses. The potential difference between turns of consecutive layers can be very large, particularly at the layers' ends (corresponding to the peaks in FIG. 9). The stress is especially large between the first two layers for both transformers under analysis. However, the values obtained with or without the shield are below the dielectric strength of a varnish included as reference (56 MV/m).

One can see from FIG. 10 that the shields produce reduced interlayer stresses when compared to the unshielded case. The reduction (in percent) of the stress at each interlayer when applying the shields is shown in Table II. It can be noticed that the reduction is slightly larger when applying the varying shield. Furthermore, the shields produce an increase (by a small percentage) in the stress between layers 1 and 2 for the 50-kVA transformer. This does not present a problem since the stress is still below the dielectric strength of the varnish considered.

From FIGS. 8-10, it seems that the best two options are: 1) to use a uniform shield spaced 1 mm from the winding or 2) use a shield with a varying distance to the winding, from 0.1 to 1 mm. Both strategies keep the transient voltage below the BIL, while the interturn and interlayer stresses have acceptable levels.

Figure 11A:
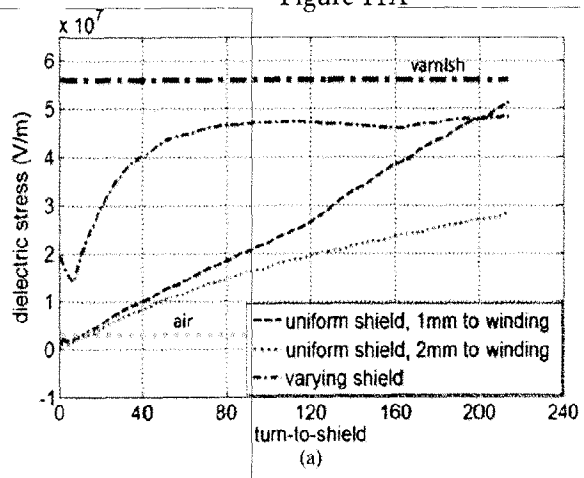
FIGS. 11A and 11B illustrate a winding-to-shield dielectric stress. (a) 25-kVA transformer. (b) 50-kVA transformer.
Figure 11B:
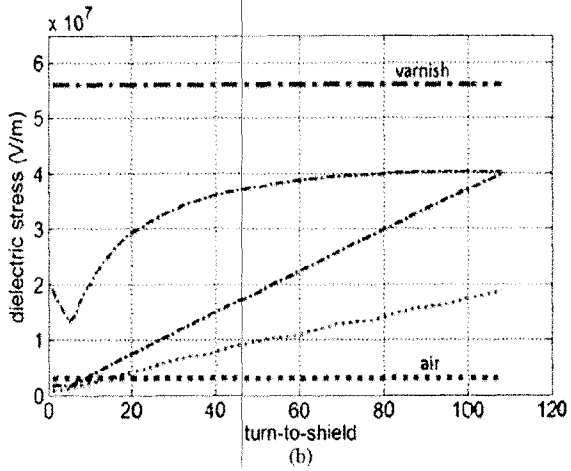

The performance of the shields in terms of the dielectric stress between the shield itself and the winding is shown in FIG. 11. While the uniform shield presents a growing behavior of the stress along the outer layer of the winding, this stress tends to be constant for the varying shield. This means that if the insulation between the winding and the shield is too thin, there is a possibility of dielectric breakdown at the end of the layer when a uniform shield is applied. However, the manufacturing process to include the varying shield is more complicated. Consequently, the uniform shield placed at the correct distance (1 mm for the cases analyzed) can be a better option. All transient voltages and stresses (between turns, layers, and to the shield) are kept at acceptable levels without requiring cumbersome manufacturing of a varying distance of shield to the winding.

The foregoing description of illustrative embodiments has been presented for purposes of illustration and of description. It is not intended to be exhaustive or limiting with respect to the precise form disclosed, and modifications and variations are possible in light of the above teachings or may be acquired from practice of the disclosed embodiments. It is intended that the scope of the invention be defined by the claims appended hereto and their equivalents.

What is claimed is:

1. A transformer comprising:

a core comprising a rolled laminate metal forming a plurality of layers including a last layer, each layer including an insulation portion and a metallic portion;

a high voltage winding disposed about the core;

a low voltage winding disposed about the core;

a shorting connection between the high voltage winding and the core wherein a portion of the shorting connection is positioned between a first turn of the rolled laminate and a second turn of the rolled laminate and further wherein the high voltage winding and the core are electrically connected by the shorting connection.

2. The transformer of claim 1, wherein the high voltage winding and the low voltage winding are disposed concentrically about the core.

3. The transformer of claim 1 wherein the shorting connection comprises a conducting component positioned in a void of the insulating portion between the first turn and the second turn of the rolled laminate, the conducting component in contact with the metallic portions.

4. The transformer of claim 3, wherein each of the first turn and the second turn having exposed metallic portions and are in conductive communication with the conducting component.

5. The transformer of claim 4, wherein the conducting component comprises a wire and a screw.

6. The transformer of claim 1, wherein the shorting connection is between a first turn of the high voltage winding and an outer layer of the core.

7. A transformer comprising:

a core having a laminated metal core wound into a coil forming a plurality of layers and forming an aperture and generally defining a toroidal shape;

the laminated metal core comprises an insulating portion and a metallic portion, such that each of the plurality of layers include an insulation portion and a metallic portion;

a first winding disposed about the core and comprising a plurality of first winding turns each of which pass through the aperture;

a second winding disposed about the core arid comprising a plurality of second winding turns each of which pass through the aperture;

an electrical connection between the first winding and the core, wherein the electrical connection is positioned between a first turn and a second turn of the wound laminate and further wherein the first winding and the core are electrically connected by the electrical connection.

8. The transformer of claim 7, wherein the first winding is a high voltage winding and the second winding is a low voltage winding.

9. The transformer of claim 7 wherein the electrical connection comprises a conducting component positioned in a void between two layers having exposed metallic portions, the conducting component in contact with the metallic portions.

10. The transformer of claim 7, wherein the electrical connection comprises of a wire and screw.

11. The transformer of claim 7, wherein the electrical connection is between a first turn of the first winding and an outer layer of the core.

* * * * *